United States Patent [19]

Ooms

[11] Patent Number: 4,476,031

[45] **Date of Patent: * Oct. 9, 1984**

[54] TEXTILE TREATMENT COMPOSITIONS

[75] Inventor: Julius Ooms, Langdorp, Belgium

[73] Assignee: The Procter & Gamble Company, Cincinnati, Ohio

[ * ] Notice: The portion of the term of this patent subsequent to Mar. 27, 2001 has been disclaimed.

[21] Appl. No.: 539,862

[22] Filed: Oct. 7, 1983

Related U.S. Application Data

[63] Continuation of Ser. No. 338,950, Jan. 12, 1982, Pat. No. 4,439,330.

[30] Foreign Application Priority Data

Jan. 16, 1981 [GB] United Kingdom ..... 8101358

[51] Int. Cl.[3] ..... D06M 13/46; D06M 13/18

[52] U.S. Cl. ..... 252/8.8; 252/8.9

[58] Field of Search ..... 252/8.8

[56] References Cited

U.S. PATENT DOCUMENTS

| | | | |
|---|---|---|---|
| 3,681,241 | 8/1972 | Rudy | 252/8.75 |
| 3,920,565 | 11/1975 | Morton | 252/8.75 |
| 4,076,632 | 2/1978 | Davis | 252/8.8 |
| 4,155,855 | 5/1979 | Goffinet et al. | 252/8.8 |
| 4,157,307 | 6/1979 | Jaeger et al. | 252/8.75 |
| 4,233,164 | 11/1980 | Davis | 252/8.8 |
| 4,326,965 | 4/1982 | Lips et al. | 252/8.8 |
| 4,401,578 | 8/1983 | Verbruggen | 252/8.8 |

FOREIGN PATENT DOCUMENTS

| | | | |
|---|---|---|---|
| 0013780 | 8/1980 | European Pat. Off. . | |
| 0018039 | 10/1980 | European Pat. Off. | 252/8.8 |
| 1619043 | 10/1969 | Fed. Rep. of Germany . | |
| 2829022 | 1/1980 | Fed. Rep. of Germany . | |

*Primary Examiner*—Maria Parrish Tungol

[57] ABSTRACT

Concentrated textile treatment compositions suitable for use in the rinse cycle of a textile laundering operation containing from 12.3% to 25% of water-insoluble cationic fabric softener or of a mixture thereof with a water-insoluble nonionic fabric softener in a weight ratio of cationic:nonionic softener of at least 2.5:1, and 0.1% to 3% of an alkoxylated amine, or ammonium derivative thereof, having the general formula I

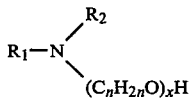

I wherein $R_1$ is $C_8$–$C_{22}$ alkyl or alkenyl, $R_2$ is $C_1$–$C_4$ alkyl or $(C_nH_{2n}O)_yH$, where n is 2 or 3 and x, y are from 0 to 14 with (x+y) from 2 to 14. The compositions provide fabric softening/static control benefits combined with excellent storage stability and viscosity characteristics.

2 Claims, No Drawings

TEXTILE TREATMENT COMPOSITIONS

This is a continuation of application Ser. No. 338,950, filed Jan. 12, 1982, now U.S. Pat. No. 4,439,330.

TECHNICAL FIELD

The present invention relates to textile treatment compositions. In particular, it relates to concentrated textile treatment compositions suitable for use in the rinse cycle of a textile laundering operation to provide fabric softening/static control benefits, the compositions being characterized by excellent storage stability and viscosity characteristics after prolonged storage at both normal and elevated temperatures.

BACKGROUND

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are di-stearyl di-methyl ammonium chloride and imidazolinium compounds substituted with two stearyl groups. These materials are normally prepared in the form of a dispersion in water and it is generally not possible to prepare such aqueous dispersions with more than about 10% of cationic material without encountering intractible problems of product viscosity and stability, especially after storage at elevated temperatures, such that the compositions are unpourable and have inadequate dispensing and dissolving characteristics in rinse water. This physical restriction on softener concentration naturally limits the level of softening performance achievable without using excessive amounts of product, and also adds substantially to the costs of distribution and packaging. Accordingly it would be highly desirable to prepare physically-acceptable textile treatment compositions containing much higher levels of water-insoluble cationic softener materials.

The problem of preparing fabric softening compositions in concentrated form suitable for consumer use has already been addressed in the art, but the various solutions have not been entirely satisfactory. It is generally known (for example in U.S. Pat. No. 3,681,241) that the presence of ionizable salts in softener, compositions does help reduce viscosity, but this approach is ineffective in compositions containing more than about 12% of dispersed softener, in as much as the level of ionizable salts necessary to reduce viscosity to any substantial degree has a seriously detrimental effect on product stability.

In European Published Patent Application No 406 concentrated fabric softeners are disclosed which comprise three active softening ingredients, one of which is a highly soluble cationic fabric substantive agent. While such compositions do allow a high concentration of active ingredient, their overall softening performance is less effective than is the case with compositions containing predominantly a water-insoluble cationic softener. In European Patent Application No. 13780, the use of low levels of paraffinic hydrocarbons, fatty acids, fatty acid esters and fatty alcohols as viscosity control agents for concentrated softener compositions is described. It has been found, however, that although these materials are excellent in reducing the viscosity of concentrated fabric softener compositions at temperatures below the Krafft point of the cationic softener, they are very much less effective as viscosity reducing agents at temperatures close to or above the Krafft point of the softener.

It has now been discovered that viscosity control in concentrated fabric softener compositions can be significantly improved, both at normal and higher temperatures, without detrimentally effecting product stability, by the addition thereto of a low level of certain alkoxylated amines, or the ammonium derivatives thereof. While the use of alkoxylated amines, as a class, in detergent and softener compositions is not new (see, for instance, German Patent Application Nos. 2829022 and 1,619,043 and U.S. Pat. Nos. 4,076,632 and 4,157,307), it appears that the value of the alkoxylated amines specifically defined herein as additives for controlling the viscosity and stability of concentrated softener compositions, has hitherto not been recognized in the art.

The present invention thus provides a concentrate aqueous textile treatment composition having improved viscosity characteristics at both normal and elevated temperatures and having good storage stability and other physical characteristics necessary for consumer use. The present invention also provides a cost-efficient, physically-acceptible concentrated textile treatment composition providing softening and anti-static benefits across the range of natural and synthetic fabric types, based on water-insoluble cationic softener as the major active component of the composition.

SUMMARY OF THE INVENTION

Accordingly, the present invention provides an aqueous textile treatment composition characterized by (a) from 12.3% to 25% by weight of a substantially water-insoluble cationic fabric softener or a mixture thereof with a substantially water-insoluble nonionic fabric softener in a weight ratio of cationic:nonionic softener of at least 2.5:1, and (b) from 0.1% to 3% by weight of an alkoxylated amine, or ammonium derivative thereof, having the general formula I

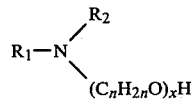

I wherein $R_1$ is a $C_8$–$C_{22}$ alkyl or alkenyl group, $R_2$ is a $C_1$–$C_4$ alkyl group or $(C_nH_{2n}O)_yH$, n is 2 or 3, and x, y are each a number average in the range from 0 to 14, the sum total of x and y being from 2 to 14.

The cationic fabric softener component of the present compositions are those water-insoluble or water-dispersible cationic organic materials conventionally employed as rinse-cycle fabric conditioning agents. Generally they have melting points in the range from about 5° C. to about 115° C., the preferred fabric softeners for use herein having a melting point in the range from 30° C. to 80° C. Preferred fabric softeners are selected from:

(a) di-$C_{12}$–$C_{24}$ alkyl or alkenyl mono- or polyammonium salts, (b) di-$C_{12}$–$C_{24}$ alkyl or alkenyl imidazolinium salts, (c) tri-$C_{12}$–$C_{24}$ alkyl or alkenyl quaternary ammonium salts, and (d) mixtures thereof.

The cationic softener or mixture thereof with nonionic softener is employed at a level in the range from 12.3% to 25%, preferably from about 13% to 22%, more preferably from about 13.5% to about 20% by weight of the textile treatment composition. The lower limits are amounts needed to contribute effective fabric conditioning performance when added to laundry rinse baths at the reduced usage volumes envisaged in the practice of the invention. The upper limits are amounts beyond which physical instability problems increasingly arise on storage of the compositions. In compositions comprising a mixture of cationic and nonionic softeners, the cationic softener preferably comprises from about 11% to about 18% thereof and the nonionic softener from about 0.2% to 5%, more preferably from about 1% to about 4% thereof.

The amount of the alkoxylated amine or ammonium derivative thereof lies in the range from 0.1% to 3%, preferably from about 0.3% to about 2.5% and especially from about 0.5% to about 1% by weight of the present compositions. In preferred embodiments, the weight ratio of the cationic fabric softener to alkoxylated amine or ammonium derivative thereof lies in the range from about 100:1 to about 12:1, more preferably from about 50:1 to about 15:1. Note that, in respect of alkoxylated amine present in the form of its ammonium derivative (e.g., in salt form), all weight percentages and ratios herein are expressed on the basis of corresponding free amine.

The level of alkoxylated amine in composition, both absolute and relative to that of the cationic softener, is highly important from the viewpoint of obtaining optimal product viscosity and stability characteristics. Outside the indicated ranges, product viscosity rapidly increases to an extent that it is no longer possible to meet simultaneous viscosity and stability objectives.

Highly preferred from the viewpoint of providing maximum viscosity reduction at minimum concentration, are alkoxylated amines, or the protonated ammonium derivatives thereof, having the general formula II

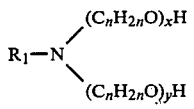

II wherein $R_1$ is a $C_{16}$–$C_{22}$ alkyl or alkenyl group, n is 2 and x, y are each a number average in the range from about 1 to about 11, preferably from about 1 to about 8, more preferably about 1 to about 5, the sum total of x and y being from about 2 to about 12, preferably from about 2 to about 10, more preferably from about 2 to about 8. By 'number average' is meant that x, y each represent the weight averaged number of moles of alkylene oxide in the corresponding polyoxyalkylene moiety of the amine. As alkyleneoxide content increases beyond the upper limits, the necessary viscosity reduction is increasingly achieved only in the presence of high levels of electrolyte which have a generally deleterious effect on product stability.

A low level of electrolyte, however, can have a beneficial effect on product viscosity without seriously diminishing phase stability, and for this reason it is preferred to include from about 50 to about 1500 parts per million, preferably from about 600 to about 1000 parts per million of an electrolyte such as calcium chloride, magnesium chloride magnesium sulfate or sodium chloride.

The compositions of the invention are generally formulated so as to have a slightly acidic pH; moreover, it is desirable that the final formulation pH be lower than the acidity constant ($pK_a$) of the amine so that the amine exists predominantly in the form of its protonated or ammonium derivative. Physically, the compositions take the form of a particulate dispersion of the cationic fabric softener in an aqueous continuum containing at least some of the alkoxylated amine or ammonium derivative thereof.

A highly preferred composition thus comprises:

(a) from about 13.5% to about 20% of a substantially water-insoluble cationic fabric softener selected from di-$C_{12}$–$C_{24}$ alkyl or alkenyl quaternary ammonium salts, di-$C_{12}$–$C_{24}$ alkyl or alkenyl imidazolinium salts and mixtures thereof, or of a mixture of the cationic fabric softener in a weight ratio of at least 2.5:1, (b) from about 0.3% to about 2.5% of an alkoxylated amine, or ammonium derivative thereof, of formula II, and (c) from about 600 to about 1000 parts per million of electrolyte, wherein the composition has a pH in the range from about 3.5 to about 7.0, preferably from about 4 to about 6 and is in the form of a particulate dispersion of cationic fabric softener in an aqueous solution comprising alkoxylated amine or ammonium derivative thereof.

The present invention also provides a method of making the textile treatment compositions generally described above by the steps of:

(a) melting the water-insoluble cationic fabric softener, and (b) intimately mixing the molten cationic fabric softener with an aqueous medium at a temperature above the Krafft point of the softener.

Preferably the compositions are prepared from a comelt of cationic fabric softener, alkoxylated amine, an acidifying agent therefor and, where present, nonionic fabric softener. Alternatively, the alkoxylated amine can be pre-dissolved in the aqueous medium at a pH of from about 3.5 to about 7.0 prior to the addition of the softener components.

In the case of dihydrogenated tallow dimethyl ammonium chloride softener, the Krafft point is about 37° C. The melting and intimate mixing steps should thus be undertaken at a temperature in excess of about 45° C.

The various ingredients of the compositions of the invention will now be discussed in detail.

The water-insoluble cationic fabric softener can be any fabric substantive cationic compound which, in pure form as a strong acid salt (e.g. chloride), has a solubility in distilled water at pH 2.5 and 20° C. of less than 1 g/l, or can be a mixture of such compounds. In this context, the soluble fraction of the surfactant is taken to be that material which cannot be separated from water by centrifugal action and which passes a 100 nm Nuclepore filter (Registered Trade Mark). In addition, the cationic softener desirably has a monomer solubility (as measured by critical micelle concentration or C.M.C.) such that the C.M.C. of the material under the conditions defined above is less than about 50 p.p.m, preferably less than about 20 p.p.m. Literature C.M.C. values are taken where possible, especially surface tension, conductimetric or dye adsorption values.

Preferred cationic softener materials are di-$C_{12}$–$C_{24}$ alkyl or alkenyl 'onium salts, especially mono- and polyammonium salts, and imidazolinium salts. Optionally, the two long chain alkyl or alkenyl groups may be substituted or interrupted by functional groups such as —OH, —O—, CONH—, —COO—, ethyleneoxy, propyleneoxy etc.

Well known species of substantially water-insoluble mono-ammonium compounds are the quaternary ammonium and amine salt compounds having the formula:

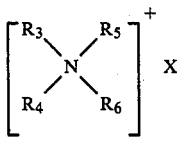

wherein $R_3$ and $R_4$ represent alkyl or alkenyl groups of from about 12 to about 24 carbon atoms optionally interrupted by amide, propyleneoxy groups etc. $R_5$ and $R_6$ represent hydrogen, alkyl, alkenyl or hydroxyalkyl groups containing from 1 to about 4 carbon atoms; and X is the salt counteranion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(-coconut alkyl) dimethyl ammonium chloride, di(-coconut alkyl) dimethyl ammonium methosulfate; di(-tallowyl amido) ethyl dimethyl ammonium chloride and di(tallowyl amido) ethyl methyl ammonium methosulfate. Of these ditallow dimethyl ammonium chloride and di(hydrogenated tallow alkyl) dimethyl ammonium chloride are preferred.

Another preferred class of water-insoluble cationic materials are the alkyl imidazolinium salts believed to have the formula:

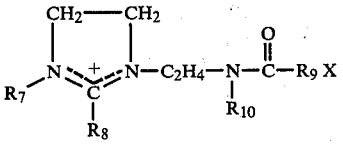

wherein $R_7$ is hydrogen or an alkyl containing from 1 to 4, preferably 1 or 2 carbon atoms, $R_8$ is an alkyl containing from 12 to 24 carbon atoms, $R_9$ is an alkyl containing from 12 to 24 carbon atoms, $R_{10}$ is hydrogen or an alkyl containing from 1 to 4 carbon atoms and X is the salt counteranion, preferably a halide, methosulfate or ethosulfate. Preferred imidazolinium salts include 3-methyl-1-(tallowylamido) ethyl-2-tallowyl-4,5-dihydroimidazolinium methosulfate and 3-methyl-1-(palmitoylamido)ethyl-2-octadecyl-4,5-dihydroimidazolinium chloride. Other useful imidazolinium materials are 2-heptadecyl-3-methyl-1-(2-stearylamido)-ethyl-4,5-dihydroimidazolinium chloride and 2-lauryl-3-hydroxyethyl-1-(oleylamido)ethyl-4,5-dihydro imidazolinium chloride. Also suitable herein are the imidazolinium fabric softening components of U.S. Pat. No. 4,127,489, incorporated herein by reference.

Representative commercially available materials of the above classes are the quaternary ammonium compounds Aliquat-2HT (Trade Mark of General Mills Inc.) and the imidazolinium compounds Varisoft 475 (Trade Mark of Sherex Company, Columbus Ohio) and Steinaquat (Trade Mark of Rewo).

Preferred tri-$C_{12}$–$C_{24}$ quaternary ammonium salts include the trihardenedtallowalkylmethylammonium salts, the trioleylmethylammonium salts and the tripalmitylmethylammonium salts. Such materials preferably constitute from about 0.2% to about 2.5%, more preferably from about 0.5% to about 2% of the composition, and from about 2% to about 10%, more preferably from about 4% to about 8% of the cationic softener.

In the compositions of the invention, the water-insoluble softener and the alkoxylated amine or ammonium derivative are present at levels in the range from about 12.3% to about 25% and from about 0.1% to about 3% respectively. The overall aim, however, is to adjust the levels and ratios of softener and amine and, if necessary, electrolyte within the prescribed amounts to provide products which are stable to separation in a centrifuge at 3000 r.p.m. for 16 hours and which have a dynamic viscosity of less than about 350 cp (0.35 Pa.s), preferably less than about 200 cp (0.2 Pa.s) measured in a Brookfield Viscometer, using Spindle No. 2 at 60 r.p.m. and at 21° C.

With regard to the alkoxylated amine component of the present compositions, this preferably is derived from a primary amine containing from about 16 to 22 carbon atoms in the alkyl chain, the higher chain length amines being found to provide greater viscosity reduction than shorter chain length amines. Especially preferred amines have an alkyl group derived from tallow or stearyl and are ethoxylated with an average of from about 2 to about 12 moles of ethylene oxide per mole of amine. Optimum from the viewpoint of maximum viscosity reduction at minimum concentration are polyethoxylated tallow amines containing from about 2 to about 5 moles of ethylene oxide per mole of amine. Materials of this type are available from Hoechst under the trade name Genamine.

The amine can be incorporated in the compositions of the invention by adding the free amine to the water seat, which is acidic in nature, prior to adding the molten softener. The final composition ordinarily has a pH in the range from about 3.5 to about 7 and at such pH's the amine is predominantly in protonated form.

In addition to the cationic softener and alkoxylated amine components, the present compositions can be supplemented by all manner of optional components conventionally used in textile treatment compositions, for example, colorants, perfumes, preservatives, optical brighteners, opacifiers, pH buffers, viscosity modifiers, fabric conditioning agents, surfactants, stabilizers such as guar gum and polyethylene glycol, anti-shrinkage agents, anti-wrinkle agents, fabric crisping agents, non-ionic softening agents, spotting agents, soil-release agents, germicides, fungicides, anti-oxidants such as butylated hydroxy toluene, anti-corrosion agents etc.

Additional viscosity control agents suitable for use in the present compositions include electrolytes such as calcium chloride, magnesium chloride, magnesium sulfate, sodium chloride etc, which can be added at levels in the range from about 50 to 1500, preferably from 600 to 1000 parts per million, and lower alcohols such as ethanol, isopropanol, propanediol, ethylene glycol, hexylene glycol and butanol added at levels up to about 10% of composition. Particularly preferred is isopropanol at a level from about 0.2% to about 4%, especially about 0.5% to 2% of composition, the weight ratio of cationic fabric softner to isopropanol preferably lying in the range from about 50:1 to about 6:1, more preferably from about 25:1 to about 12:1. A preferred additional phase stabilizer material is a polyethyleneglycol having a molecular weight in the range from about 1000 to about 40,000, especially from about 4000 to about 15,000, and comprising from about 0.1% to about 5%, preferably from about 1% to about 4% by weight of composition.

Suitable nonionic softening agents include $C_{10}$–$C_{24}$ linear or branched, preferably non-cyclic hydrocarbons, the esters of $C_{10}$–$C_{24}$ fatty acids with mono or polyhydric alcohols, especially those containing from 1 to about 8 carbon atoms, $C_{10}$–$C_{24}$ fatty alcohols, and mixtures thereof. Preferred hydrocarbons are linear or branched paraffins or olefines containing from about 14 to about 22 carbon atoms. Materials known generally as paraffin oil, soft paraffin wax and petrolatum are especially suitable. Particularly suitable are paraffin oils derived from mineral sources such as petroleum. Examples of specific materials are tetradecane, hexadecane, octadecane and octadecene. Preferred commercially-available paraffin mixtures include spindle oil, light oil, technical grade mixtures of $C_{14}/C_{17}$ n-paraffins and $C_{18}/C_{20}$ n-paraffins and refined white oils. Suitable materials of the fatty acid class are the $C_{10}$–$C_{20}$ saturated fatty acids, especially lauric acid, myristic acid, palmitic acid and stearic acid. Esters of such acids with $C_1$–$C_4$ monohydric alcohols or with polyhydric alcohols are particularly useful. Examples of such materials are methyl laurate, ethyl myristate, ethyl stearate, butyl stearate, methyl palmitate, methyl oleate, polyethyleneglycol monostearate, glyceryl monostearate and sorbitan monooleate. Suitable fatty alcohols include cetyl alcohol, tallow alcohol, lauryl alcohol and myristyl alcohol.

A water-soluble surfactant component, other than the alkoxylated surfactant of formula I, can also be added to the present compositions although such materials are preferably maintained at a level of less than about 3%, more preferably less than 1% of composition, and less than about 10% more preferably less than 4% of the cationic softener component, Suitable water-soluble cationic surfactants are mono-C–$C_{24}$ alkyl or alkenyl quaternary ammonium salts, imidazolinium salts, pyridinium salts and mixtures thereof.

Suitable water-soluble quaternary ammonium compounds have the general formula:

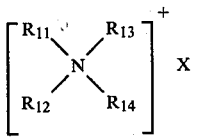

wherein $R_{11}$ represents a $C_8$–$C_{24}$ alkyl or alkenyl group, $R_{12}$ represents a $C_1$–$C_4$ alkyl, alkenyl or hydroxyalkyl group, an aryl group, or a poly(ethylene oxide) group having from 2 to 20 ethylene oxide units, $R_{13}$, $R_{14}$ individually represent a $C_1$–$C_4$ alkyl, alkenyl or hydroxyalkyl group or a poly(ethylene oxide) group having from 2 to 20 ethylene oxide units and X is as defined above.

Highly preferred materials of this general type include the tallow trimethyl ammonium salts, cetyl trimethyl ammonium salts, myristyl trimethyl ammonium salts, coconutalkyl trimethyl ammonium salts, dodecyl dimethyl hydroxypropyl ammonium salts, myristyl dimethyl hydroxyethyl ammonium salts, dodecyl dimethyl dioxyethylenyl ammonium salts, myristyl benzyl hydroxyethyl methyl ammonium salts, coconutalkyl benzyl hydroxyethyl methyl ammonium salts, dodecyl dihydroxyethyl methyl ammonium salts, cetyl dihydroxyethyl methyl ammonium salts, and stearyl dihydroxyethyl methyl ammonium salts.

Highly preferred water-soluble imidazolinium materials are represented by the general formula

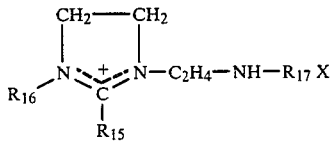

or acids salts thereof, wherein $R_{15}$ represents a $C_8$–$C_{24}$ alkyl or alkenyl group, $R_{16}$ represents hydrogen, a $C_1$–$C_4$ alkyl, alkenyl or hydroxyalkyl group, an aryl group or a poly(ethylene oxide) group having from 2 to 20 ethylene oxide units and $R_{17}$ represents hydrogen, a $C_1$–$C_4$ alkyl, alkenyl or hydroxyalkyl group or a poly(ethylene oxide) group having from 2 to 20 ethylene units and X is as defined above.

Preferred imidazolinium salts of the general formula include the compounds in which $R_{16}$ is methyl or hydrogen, $R_{15}$ is tallowyl and $R_{17}$ is hydrogen and the compounds in which $R_{16}$ is methyl or hydrogen, $R_{15}$ is palmitoyl and $R_{17}$ is hydrogen.

Suitable water-soluble nonionic surfactants are selected from $C_8$–$C_{24}$ fatty alcohols ethoxylated with an average of 5 to 100 moles, preferably 7 to 40 moles of ethylene oxide per mole of alcohol. Preferred materials of this class include tallow alcohol ethoxylated with from about 11 to about 25 moles of ethylene oxide.

In addition to the above-mentioned components, the compositions may contain other textile treatment or conditioning agents. Such agents include silicones, as for example described in German Patent Application DOS No 26 31 419 incorporated herein by reference. The optional silicone component can be used in an amount of from about 0.1% to about 6%, preferably from 0.5% to 2% of the softener composition.

Another optional ingredient of the present compositions is a water-soluble cationic polymer having a molecular weight in the range from about 2000 to 250,000, preferably from about 5000 to 150,000 and containing an average of from about 100 to about 1000, preferably from about 150 to 700 monomer units per molecule. Molecular weights are specified as viscosity average molecular weights and can be determined as described in F. Daniels et al Experimental Physical Chemistry, pp 71–74, 242–246, McGraw-Hill (1949), at 25° C. using an Ostwald viscometer. The polymers are preferably soluble in distilled water to the extent of 0.5% by weight at 20° C. Such polymers can provide valuable softening robustness in the presence of anionic surfactant carried over from a previous cleaning operation, and also contribute to viscosity control. Suitable polymers of this type include polyethylenimine having an average molecular weight of from about 10,000 to about 35,000, ethoxylated polyethyleneimine wherein the weight ratio of polyethylenimine to ethyleneoxide is at least 1:1 and wherein the molecular weight is from about 20,000 to about 70,000, and quaternized polyethylenimines sold under the Trade Name Alcostat by Allied Colloids.

Suitable preservatives for use in the present compositions include 2-nitro-2-bromo-propane-1,3-diol, glutaraldehyde and 2-methyl-4-isothiazolin-3-one and its 5-chloro derivative.

The textile treatment compositions of the invention can be used by adding to the rinse cycle of a conventional home laundry operation. Generally, rinse water has a temperature of from about 5° C. to about 60° C. C. The concentration of the total active ingredients is generally from about 2 ppm to about 1000 ppm, preferably from about 10 ppm to about 500 ppm, by weight of the aqueous rinsing bath.

In general, the present invention in its textile treatment method aspect comprises (a) washing fabrics in a conventional washing machine with a detergent composition; (b) rinsing the fabrics; (c) adding during the rinsing stage of the operation the above-described amounts of cationic fabric softener in an aqueous liquid composition containing a specified amount of alkoxylated amine as hereinbefore described; and (d) drying the fabrics.

The detergent composition normally contains an anionic, nonionic, amphoteric or ampholytic surfactant or a mixture thereof, and frequently contains in addition an organic or inorganic builder. When multiple rinses are used, the fabric conditioning composition is preferably added to the final rinse. Fabric drying can take place either in the open air or in an automatic dryer.

The following examples illustrate the invention. In the Examples, the following abbreviations are used:

| | |
|---|---|
| Ditallow dimethyl ammonium chloride | DTDMAC |
| Didocosyl dimethyl ammonium chloride | DDDMAC |
| Dilauryl diethyl ammonium methosulfate | DLDEAM |
| 3-methyl-1-(2-tallowylamido)ethyl-2-tallowyl-4,5-dihydroimidazolinium methosulphate | MDTIM |
| 1-(2-tallowlamido)ethyl-2-tallowyl-4,5-dihydroimidazolinium methosulphate | DTIM |
| Bis(2-tallowylamido ethyl)dimethyl ammonium chloride | DTEMAC |
| Tallow trimethyl ammonium chloride | MTTMAC |
| 3-methyl-1-(2-ammonio)ethyl-2-tallowyl-4,5-dihydroimidazolinium methosulphate | MMTIM |
| 1-(2-ammonio)ethyl-2-tallowyl-4,5-dihydroimidazolinium methosulphate | MTIM |
| Tritallow methyl ammonium chloride | TTMAC |
| Ethoxylated polyethyleneimine having a weight ratio of polyethyleneimine to ethylene oxide of about 1.3:1 and a molecular weight of about 60,000 | EOPEI |
| Mixture of 5-chlor-2-methyl-4-isothiazolin-3-one and 2-methyl-4-isothiazolin-3-one, marketed by Rohm and Haas | Kathon WT |

NB: the materials DTIM, MMTIM and MTIM may, depending on composition pH, contain minor proportions of the corresponding unprotonated materials.

EXAMPLES I TO VIII

A concentrated liquid fabric softener was prepared having the following composition.

| Ingredient | % by Weight |
|---|---|
| Ditallowdimethylammonium chloride | 15.0 |
| Ethoxylated (5 EO) stearyl amine | 1.0 |
| Hydrochloric acid (37%) | 0.16 |
| Calcium chloride (10% aqueous solution) | 0.35 |
| Minor ingredients inclusive of dye, polyethylene glycol and water | Balance to 100 |

The ditallowdimethylammonium chloride was melted at about 65° C. and slowly added to a warm (60° C.) water seat containing the ethoxylated amine, protonated with hydrochloric acid, and the minor ingredients. The mixture was then stirred for about 20 minutes. The calcium chloride was subsequently added to the warm mixture.

The viscosity of the 60° C. mixture measured as described earlier with a BROOKFIELD viscometer, was 175 cp (0.175 Pa.s). The concentrated liquid fabric softener so prepared was then cooled to ambient temperature, and perfumed. The final composition had a viscosity of 170 cp (0.17 Pa.s) at 25° C.

After 3 weeks storage at ambient temperature, the softener product remained homogenous with essentially unchanged viscosity.

The product provided excellent softening performance across the range of natural and synthetic fabrics; moreover, it displayed excellent dispensing and dissolving characteristics in cold rinse water. Improved physical characteristics are also obtained when the ethoxylated amine is replaced by an equal quantity of palmitylamine ethoxylated with an average of 5 ethyleneoxy groups (Example II), tallowylamine ethoxylated with an average of 8 ethyleneoxy groups (Example III), myristylamine ethoxylated with an average of 4 ethyleneoxy groups (Example IV), coconutamine ethoxylated with an average of 3 ethyleneoxy groups (Example V), laurylamine ethoxylated with an average of 2 ethyleneoxy groups (Example VI), stearylamine ethoxylated with an average of 10 ethyleneoxy groups (Example VII) and docosylamine ethoxylated with an average of 12 ethyleneoxy groups (EXAMPLE VIII).

EXAMPLES IX TO XII

Example IX to XII were prepared in the same manner as the composition of Example I.

| | Examples (Wt %) | | | |
|---|---|---|---|---|
| Ingredients | IX | X | XI | XII |
| Ditallowdimethylammonium chloride | 15.0 | 13.0 | 15.0 | 16.0 |
| Ethoxylated stearic amine (5 EO) | 2.0 | 1.0 | — | 3.0 |
| Ethoxylated coconut amine (5 EO) | — | — | 1.0 | — |
| Hydrochloric acid (37%) | 0.32 | 0.16 | 0.26 | 0.48 |
| Calcium chloride (10% solution) | 0.35 | 0.2 | 0.5 | 0.6 |
| Minor ingredients + water | balance to 100 | | | |
| Viscosity at 65° C. (Pa.s) | 0.17 | 0.15 | 1.0 | 0.425 |
| Viscosity at 25° C. (Pa.s) | 0.15 | 0.185 | 0.45 | 0.47 |

The above products were stable in respect to phase stability and viscosity, and gave outstanding fabric softening and static control performance upon use in the rinse cycle of a washing machine.

EXAMPLES XIII TO XV

Further compositions of this invention were prepared as described in Example I above. The pH was adjusted to about 4.8.

| Ingredients | Examples (Wt %) XIII | XIV | XV |
|---|---|---|---|
| Ditallowdimethylammonium chloride | 16 | 15 | 16 |
| Ethoxylated (5 EO) tallow amine | 1 | — | — |
| Ethoxylated (8 EO) stearic amine | — | 0.5 | — |
| Ethoxylated (2 EO) stearic amine | — | — | 1 |
| Calcium chloride (in ppm) | 500 | 350 | 450 |
| Minors | | balance to 100 | |
| Viscosity at 65° C. (Pa.s) | 0.75 | 0.105 | 0.1 |
| Viscosity at 25° C. (Pa.s) | 0.11 | 0.12 | 0.1 |

EXAMPLES XVI TO XXII

Additional liquid textiles treatment compositions are prepared in the manner of Example I, pH being adjusted to about 4.8 to 5.0.

| Ingredients | Examples (wt %) XVI | XVII | XVIII | XIX | XX | XXI | XXII |
|---|---|---|---|---|---|---|---|
| DTDMAC | 13.5 | — | — | 4 | — | — | 6 |
| MTTMAC | 1.5 | — | — | 1 | — | — | — |
| DDDMAC | — | 8 | — | — | — | — | — |
| DLDEAM | — | 7 | — | — | — | — | — |
| MDTIM | — | — | 8 | 6 | 16 | 5 | 4 |
| MMTIM | — | — | 1 | 1 | 1 | 0.6 | 0.5 |
| DTIM | — | — | 5 | 4 | 1 | 3 | 2 |
| DTEMAC | — | — | 0.3 | 0.1 | — | 0.5 | 0.4 |
| MTIM | — | — | 1 | 1 | — | 1 | 0.5 |
| Ethoxylated (5 EO) palmityl amine | 1 | — | — | — | 2 | — | — |
| Ethoxylated (3 EO) coconut amine | — | — | 2 | — | — | 1.5 | — |
| Ethoxylated (12 EO) docosyl amine | — | 0.5 | — | 1.5 | — | — | — |
| Calcium chloride (ppm) | — | 500 | 300 | — | — | 350 | 400 |
| Magnesium sulfate (ppm) | 350 | — | — | 400 | 600 | — | — |
| Silicone DC-346 (Dow Corning) | 0.2 | 0.1 | 0.3 | — | 0.3 | 0.2 | — |
| 2-Nitro-2-bromo-propane-1,3-diol (ppm) | 100 | — | — | 150 | — | 100 | — |
| Glutaraldehyde (ppm) | — | 400 | — | — | 600 | — | — |
| Kathon WT (ppm) | — | — | 10 | — | — | — | 15 |
| Butylated hydroxytoluene | 0.2 | — | 0.2 | 0.1 | 0.1 | 0.2 | — |
| n-C14-C17-paraffin | — | — | — | — | 4 | 12 | 4 |
| Guar gum | — | — | 0.1 | — | — | — | — |
| EOPEI | — | 0.2 | — | — | 1.0 | — | 0.2 |
| Polyethylene glycol | 0.5 | — | — | 0.2 | — | — | — |
| Perfume, dye, solvent, and water | | | | balance to 100 | | | |

The above products display excellent softening characteristics on both natural and synthetic fabrics, low viscosity at both normal and elevated temperatures, and good product stability and dispersibility, compared with compositions containing no alkoxylated amine.

EXAMPLES XXIII TO XXVII

Additional liquid textile treatment compositions are prepared as follows. The cationic fabric softener is melted at about 65° C. and the ethoxylated amine, acidifying agent and nonionic fabric softener are added thereto. The comelt at a temperature of about 65° C. is then to a warm (45° C.) water seat containing the minor ingredients and the mixture stirred for about 20 minutes. The electrolyte is subsequently added to the warm mixture. The final pH is about 4.8 to 5.0.

| | EXAMPLES XXIII | XXIV | XXV | XXVI | XXVII |
|---|---|---|---|---|---|
| DTDMAC | 14 | 12 | — | 4 | — |
| MTTMAC | 0.4 | 0.6 | — | 0.2 | — |
| TTMAC | 0.6 | 0.6 | — | 0.2 | — |
| MDTIM | — | — | 13 | 8 | 5 |
| DTIM | — | — | 1 | 0.5 | .5 |
| Ethoxylated (2 EO) tallowamine, phosphate salt | — | 0.8 | 0.6 | — | 0.5 |
| Ethoxylated (5 EO) stearylamine, benzoate salt | 1.0 | — | — | 0.7 | — |
| Glyceryl monostearate | 2.5 | 3 | — | — | 3 |
| $C_{20}$-$C_{24}$ branched paraffins | — | — | 3.5 | 2.5 | — |
| Calcium chloride (ppm) | 600 | 700 | 650 | 800 | 950 |
| Sodium chloride (ppm) | 300 | 200 | — | 100 | — |
| Polyethylene glycol (6,000-8,000 m. wt) | — | 2 | — | — | .5 |
| Isopropanol | 2 | 0.7 | 1.2 | 0.9 | .0 |
| Perfume, dye, preservatives and water | | | to 100 | | |

The above products display excellent softening characteristics on both natural and synthetic fabrics, low viscosity at both normal and elevated temperatures, and good product stability and dispersability, compared with compositions containing no alkoxylated amine.

I claim:

1. An aqueous textile treatment composition comprising:

(a) from 12.3% to 25% by weight of substantially water-insoluble fabric softener selected from the group consisting of cationic fabric softeners and mixtures thereof with substantially water-insoluble nonionic fabric softeners in a weight ratio of cationic softener:nonionic softener of at least 2.5:1, and (b) from 0.1% to 3% by weight of alkoxylated amine, or ammonium derivative thereof, having the general formula I

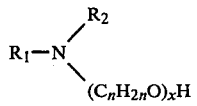

I wherein $R_1$ is a $C_8$–$C_{22}$ alkyl or alkenyl group, $R_2$ is a $C_1$–$C_4$ alkyl group or $(C_nH_{2n}O)_yH$, n is 2 or 3, and x and y are each a number average in the range from 0 to 14, the sum total of x and y being from 2 to 14;

said composition being free of hydrocarbon and fatty acid ester nonionic fabric softeners.

2. An aqueous textile treatment composition comprising:

(a) from 12.3% by weight of substantially water-insoluble fabric softener selected from the group consisting of cationic fabric softeners and mixtures thereof with substantially water-insoluble nonionic fabric softeners in a weight ratio of cationic softener:nonionic softener of at least 2.5:1, and (b) from 0.1% to 3% by weight of alkoxylated amine, or ammonium derivative thereof, having the general formula I

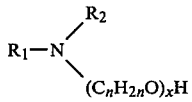

I wherein $R_1$ is a $C_8$–$C_{22}$ alkyl or alkenyl group, $R_2$ is $(C_nH_{2n}O)_yH$, n is 2 or 3, and x and y are each a number average of at least 1 and the sum total of x and y is 2 or 3.

* * * * *

UNITED STATES PATENT AND TRADEMARK OFFICE

CERTIFICATE OF CORRECTION

PATENT NO. : 4,476,031

DATED : October 9, 1984

INVENTOR(S) : JULIUS OOMS

It is certified that error appears in the above-identified patent and that said Letters Patent is hereby corrected as shown below:

Claim 2, line 3 (column 14, line 1), after "12.3%" insert --to 25%--.

Signed and Sealed this

*Twenty-first* Day of *May 1985*

[SEAL]

*Attest:*

DONALD J. QUIGG

*Attesting Officer* *Acting Commissioner of Patents and Trademarks*